US008512017B2

(12) United States Patent
Yamamoto et al.

(10) Patent No.: US 8,512,017 B2
(45) Date of Patent: Aug. 20, 2013

(54) COMPRESSION MECHANISM AND SCROLL COMPRESSOR INCLUDING THE SAME

(75) Inventors: Satoshi Yamamoto, Sakai (JP); Mikio Kajiwara, Sakai (JP); Mitsuhiko Kishikawa, Sakai (JP); Hiroyuki Yamaji, Sakai (JP); Mie Arai, Sakai (JP); Yasuhiro Murakami, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 791 days.

(21) Appl. No.: 12/671,282

(22) PCT Filed: Aug. 5, 2008

(86) PCT No.: PCT/JP2008/063988

§ 371 (c)(1),
(2), (4) Date: Jan. 29, 2010

(87) PCT Pub. No.: WO2009/020106

PCT Pub. Date: Feb. 12, 2009

(65) Prior Publication Data

US 2010/0202910 A1 Aug. 12, 2010

(30) Foreign Application Priority Data

Aug. 6, 2007 (JP) ..... 2007-204780

(51) Int. Cl.
*F04C 18/02* (2006.01)
*F04C 29/00* (2006.01)

(52) U.S. Cl.
USPC ..... 418/55.2; 418/55.1; 418/55.3

(58) Field of Classification Search
USPC ..... 418/55, 55.1, 55.2, 55.3, 55.4, 55.5
See application file for complete search history.

(56) References Cited

U.S. PATENT DOCUMENTS

| | | | | |
|---|---|---|---|---|
| 5,984,653 | A * | 11/1999 | Misiak | 418/55.1 |
| 7,963,753 | B2 * | 6/2011 | Bush | 418/55.4 |
| 2008/0145253 | A1 * | 6/2008 | Uekawa | 418/55.3 |
| 2008/0152527 | A1 * | 6/2008 | Takahashi et al. | 418/55.3 |

FOREIGN PATENT DOCUMENTS

| | | | |
|---|---|---|---|
| JP | 06-317269 | A | 11/1994 |
| JP | 09-206908 | A | 8/1997 |
| JP | 2005-36693 | A | 2/2005 |
| JP | 2007-136466 | A | 6/2007 |
| RU | 2011114399 | A | 2/2003 |
| RU | 63001 | U1 | 5/2007 |

OTHER PUBLICATIONS

Russian Decision of Grant of corresponding Russian Application No. 2010108271 dated May 12, 2011.

* cited by examiner

*Primary Examiner* — Kenneth Bomberg
*Assistant Examiner* — Dapinder Singh
(74) *Attorney, Agent, or Firm* — Global IP Counselors

(57) ABSTRACT

A compression mechanism is configured to be used in a scroll compressor. The compression mechanism includes a fixed scroll and a movable scroll. One of the fixed scroll and the movable scroll is a cast iron molding fabricated through semi-molten die casting, and the other of the fixed scroll and the movable scroll is a grey iron casting.

14 Claims, 17 Drawing Sheets

| materials | surface pressure for seizing to occur (MPa) | graphite area ratio (%) | | | HRB | |
|---|---|---|---|---|---|---|
| | | slider A | slider B | slider A+ slider B | slider A | slider B |
| FC250s | 169 | 14 | 14 | 28 | 93 | 93 |
| semi-molten die cast molding/ FC250 | 152 | 2 to 6 | 8 to 14 | 10 to 20 | 90 to 100 | 90 to 100 |
| semi-molten die cast moldings | 140 | 4.0 | 4.0 | 8 | 98 | 98 |

COMPRESSION MECHANISM AND SCROLL COMPRESSOR INCLUDING THE SAME

CROSS-REFERENCE TO RELATED APPLICATIONS

This U.S. National stage application claims priority under 35 U.S.C. §119(a) to Japanese Patent Application No. 2007-204780, filed in Japan on Aug. 6, 2007, the entire contents of which are hereby incorporated herein by reference.

TECHNICAL FIELD

The present invention relates to a compression mechanism and a scroll compressor including the compression mechanism. Particularly, the present invention relates to materials used in the compression mechanism.

BACKGROUND ART

A scroll compressor includes a compression mechanism to compress refrigerant. The compression mechanism includes a fixed scroll and a movable scroll. Each of the two scrolls has a scroll portion which extends in an involute shape. The two scroll portions engage with each other.

Conventionally, the fixed scroll has been formed of the same material as the movable scroll. Some examples of the materials are a grey iron casting, a cast iron molding fabricated through semi-molten die casting, and so forth.

Japanese Laid-open Patent Application No. 2005-36693 discloses the related art to the present invention.

SUMMARY

Technical Problem

Unfortunately, when the fixed scroll is formed of the same material as the movable scroll, the following two problems can be raised.

First, even if the compression mechanism is formed to have high strength and high stiffness, seizing will occur between the fixed scroll and the movable scroll. The seizing can halt the operation of the compression mechanism. This problem will become significant when the scrolls are cast iron moldings fabricated through semi-molten die casting.

Second, even if the scrolls are formed to have little chance of seizing, the compression mechanism will have low strength and low stiffness. In order to downsize the compression mechanism and maintain the intake capacity thereof simultaneously, the scrolls need to have their involute scroll portions thinner and longer in height. However, low strength and low stiffness of the compression mechanism can cause deformation or rupture of the involute scroll portions during operation. This problem will become significant when the scrolls are grey iron castings.

The present invention solves the above problems. The present invention has an object to increase strength and stiffness of a compression mechanism and to prevent seizing thereof simultaneously.

Solution to Problem

A compression mechanism according to a first aspect of the present invention is used in a scroll compressor, and includes a fixed scroll and a movable scroll. One of the two scrolls is a cast iron molding fabricated through semi-molten die casting, and the other is a grey iron casting.

A compression mechanism according to a second aspect of the present invention is the compression mechanism according to the first aspect of the present invention, wherein the sum of a graphite area ratio on the surface of the cast iron molding and a graphite area ratio on the surface of the grey iron casting is greater than or equal to 10% and less than or equal to 20%.

A compression mechanism according to a third aspect of the present invention is the compression mechanism according to the second aspect of the present invention, wherein the graphite area ratio on the surface of the cast iron molding is greater than or equal to 2% and less than or equal to 6%.

A compression mechanism according to a fourth aspect of the present invention is the compression mechanism according to any one of the first to third aspects of the present invention, wherein a tensile strength of the grey iron casting is greater than or equal to 250 $N/mm^2$ and less than 300 $N/mm^2$.

A compression mechanism according to a fifth aspect of the present invention is the compression mechanism according to any one of the first to forth aspects of the present invention, wherein the fixed scroll is the grey iron casting, and the movable scroll is the cast iron molding.

A compression mechanism according to a sixth aspect of the present invention is the compression mechanism according to the fifth aspect of the present invention, wherein the movable scroll is placed and pushed against the fixed scroll.

A compression mechanism according to a seventh aspect of the present invention is the compression mechanism according to the fifth or sixth aspect of the present invention, wherein the fixed scroll has a first scroll portion and a first plate portion, and the movable scroll has a second scroll portion and a second plate portion. The first and second scroll portions extend in involute shapes. The first scroll portion engages with the second scroll portion. The first and second plate portions hold the first and second scroll portions respectively. The first plate portion has a through hole which connects a first space and a second space. The first space has an involute shape defined by the first scroll portion. The second space is located on the opposite side of the movable scroll. The second scroll portion is arranged to cover an opening of the through hole. The opening is located on the side of the first space.

A compression mechanism according to an eighth aspect of the present invention is the compression mechanism according to the seventh aspect of the present invention, wherein the first scroll portion covers a portion of the opening of the through hole, as viewed from the side of the movable scroll.

A compression mechanism according to a ninth aspect of the present invention is the compression mechanism according to any one of the fifth to eighth aspects of the present invention, wherein the fixed scroll has a first scroll portion, and the movable scroll has a second scroll portion. The first and second scroll portions extend in involute shapes. The first scroll portion engages with the second scroll portion. The movable scroll has an extended portion which extends from the end of the outmost wall of the second scroll portion. The extended portion does not engage with the first scroll portion.

A compression mechanism according to a tenth aspect of the present invention is the compression mechanism according to any one of the first to ninth aspects of the present invention, wherein the fixed scroll has a first scroll portion, and the movable scroll has a second scroll portion. The first and second scroll portions extend in involute shapes. The first scroll portion engages with the second scroll portion. A thickness ratio of a first thickness to a second thickness is equal to a value calculated based on a Young's modulus ratio of the Young's modulus of the cast iron molding to the Young's modulus of the grey iron casting. In this case, the first thickness is the thickness of the first or second scroll portion of the cast iron molding, and the second thickness is the thickness of the first or second scroll portion of the grey iron casting.

A compression mechanism according to an eleventh aspect of the present invention is the compression mechanism according to the tenth aspect of the present invention, wherein the thickness ratio is less than or equal to the reciprocal of the Young's modulus ratio.

A compression mechanism according to a twelfth aspect of the present invention is the compression mechanism according to the tenth or eleventh aspect of the present invention, wherein the Young's modulus of the cast iron molding is 175 GPa or more and 190 GPa or less.

A scroll compressor according to a thirteenth aspect of the present invention includes the compression mechanism according to any one of the first to twelfth aspects of the present invention.

A scroll compressor according to a fourteenth aspect of the present invention is the scroll compressor according to the thirteenth aspect of the present invention, wherein the scroll compressor compresses refrigerant composed mostly of carbon dioxide

Advantageous Effects of Invention

The compression mechanism according to the first aspect has a fixed scroll and a movable scroll. One of the two scrolls is a cast iron molding fabricated through semi-molten die casting, while the other is a grey iron casting. Therefore, in this compression mechanism, seizing does not occur frequently between the fixed scroll and the movable scroll, unlike in a compression mechanism which includes a fixed scroll and a movable scroll, both of which are cast iron moldings fabricated through semi-molten die casting.

Additionally, when each of the fixed scroll and the movable scroll has a scroll portion which extends in an involute shape and engages with the other scroll portion, the compression mechanism of the present invention can have thinner scroll portions, unlike a compression mechanism which includes a fixed scroll and a movable scroll, both of which are grey iron castings. This is because a cast iron molding fabricated through semi-molten die casting has higher strength and higher stiffness than a grey iron casting. Therefore, this compression mechanism can be downsized and maintain its intake capacity simultaneously. This compression mechanism can also keep its size unchanged and achieve higher intake capacity simultaneously.

Additionally, this compression mechanism can prevent deformation thereof caused by compression pressure. This is because a cast iron molding fabricated through semi-molten die casting has higher stiffness than a grey iron casting. Therefore, compressed refrigerant hardly leaks out of this compression mechanism, which prevents a decrease of the compression efficiency.

The compression mechanism according to the second aspect has a large sum of the graphite area ratios, which can easily prevent seizing between the fixed scroll and the movable scroll.

The compression mechanism according to the third aspect can secure the graphite area ratio on the surface of the cast iron molding, which is sufficient to prevent seizing. This compression mechanism can easily prevent seizing between the fixed scroll and the movable scroll.

The compression mechanism according to the fourth aspect can have the strength and the stiffness sufficient to prevent deformation or rupture of this compression mechanism.

When each of the fixed scroll and the movable scroll has a scroll portion which extends in an involute shape and engages with the other scroll portion, the compression mechanism according to the fifth aspect can have thinner scroll portions, unlike a compression mechanism which includes a fixed scroll and a movable scroll, both of which are grey iron castings. This is because a cast iron molding fabricated through semi-molten die casting has higher strength and higher stiffness than a grey iron casting. Therefore, this compression mechanism can be downsized and maintain its intake capacity simultaneously. This compression mechanism can also keep its size unchanged and achieve higher intake capacity simultaneously.

Additionally, the movable scroll can be lightweight, which reduces torque required to operate the movable scroll.

Additionally, the cast iron molding fabricated through semi-molten die casting can reduce the cost of this compression mechanism.

The compression mechanism according to the sixth aspect can prevent a gap between the scroll portion of the fixed scroll and that of the movable scroll, whereby prevents the decrease of the compression efficiency.

Additionally, the movable scroll is unlikely to deform when pushed against the fixed scroll. This is because the movable scroll is the cast iron molding fabricated through semi-molten die casting which has high strength and high stiffness.

The compression mechanism according to the seventh aspect can prevent the decrease of the compression efficiency. This is because the through hole does not connect the first spaces on two sides of the scroll portion of the movable scroll, when the scroll portion of the movable scroll passes by an opening of the through hole. More specifically, in this case, the first spaces defined by the scroll portion do not connect to each other via the through hole.

The compression mechanism according to the eighth aspect has an opening of the through hole on the side of the second space, and this opening can be bigger than an opening on the side of the first space. Therefore, compressed refrigerant can pass through the through hole more efficiently.

The compression mechanism according to the ninth aspect has the movable scroll with the extended portion, which increases strength and stiffness of the end of the outmost wall of the movable scroll. Therefore, the extended portion prevents deformation of the outmost wall of the movable scroll during fabrication.

The compression mechanism according to the tenth aspect can have substantially equal amounts of bending between the two scroll portions, wherein one of the scroll portions is a cast iron molding fabricated through semi-molten die casting, while the other is a grey iron casting. This is because the thickness ratio of the scroll portions is calculated based on the Young's modulus ratio of the scroll portions. The compression mechanism can prevent the decrease of the compression efficiency due to the bending of the scroll portions.

The compression mechanism according to the eleventh aspect can be downsized. This is because a scroll portion of the cast iron molding can be made thinner.

The compression mechanism according to the twelfth aspect can prevent the decrease of the compression efficiency due to the bending of the cast iron molding.

The scroll compressor according to the thirteenth aspect can prevent seizing between the fixed scroll and the movable scroll of the compression mechanism. Therefore, the scroll compressor is less prone to breakdown.

The scroll compressor according to the fourteenth aspect can improve the compression efficiency, even when carbon dioxide is used as refrigerant.

DETAILED DESCRIPTION OF EMBODIMENT(S)

Figure 1:
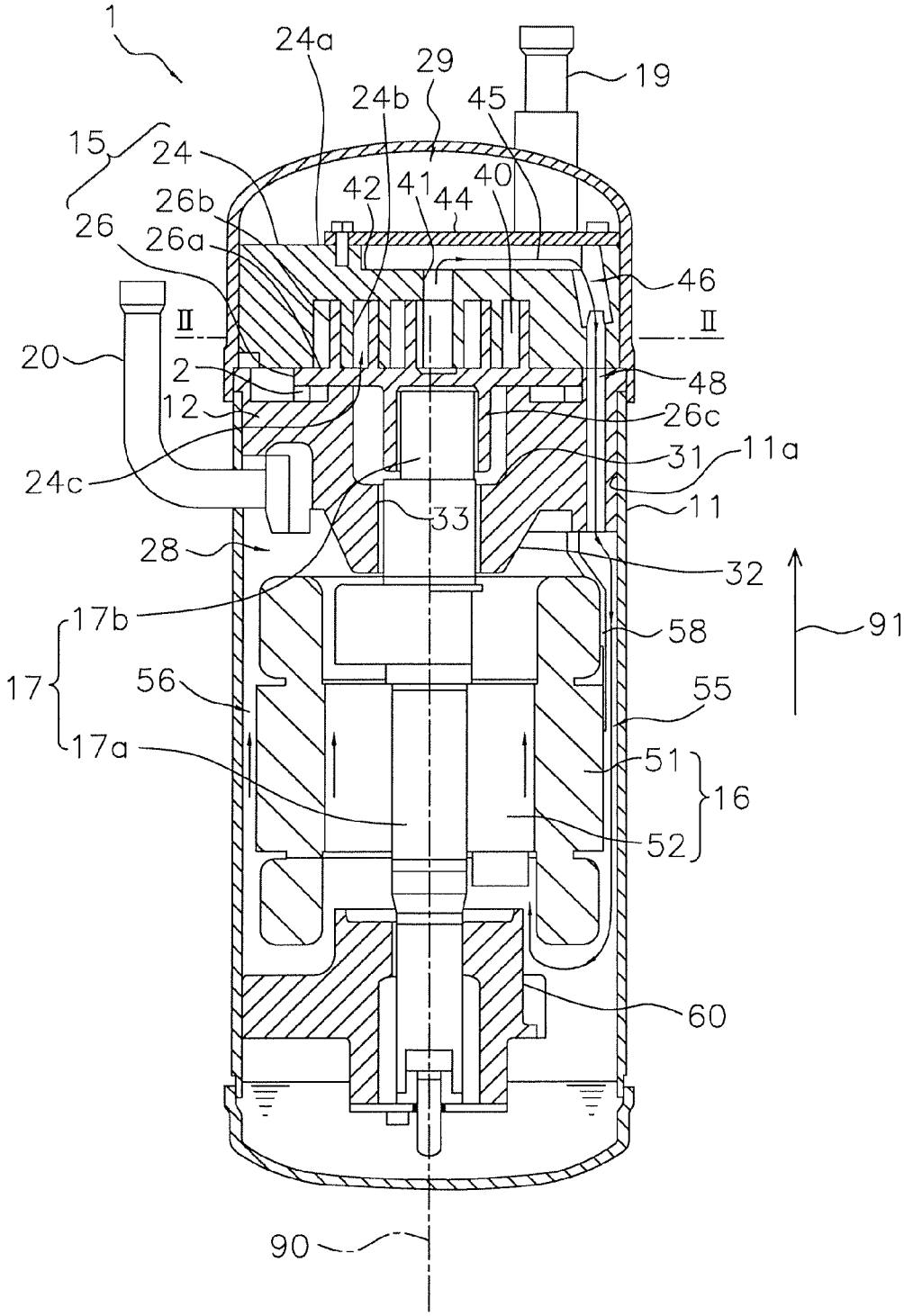
FIG. 1 is a schematic cross-sectional view of a scroll compressor according to an embodiment of the present invention.

FIG. 1 shows a schematic view of a scroll compressor 1 according to an embodiment of the present invention. Hereinafter, "the upper side" is defined as a side pointed by an arrow 91 shown in FIG. 1, and "the lower side" is defined as the opposite side to the upper side.

The scroll compressor 1 includes a casing 11 and a compression mechanism 15. The casing 11 is a cylindrical body elongated along the arrow 91. The compression mechanism 15 is disposed inside the casing 11.

Figures 2, 3:
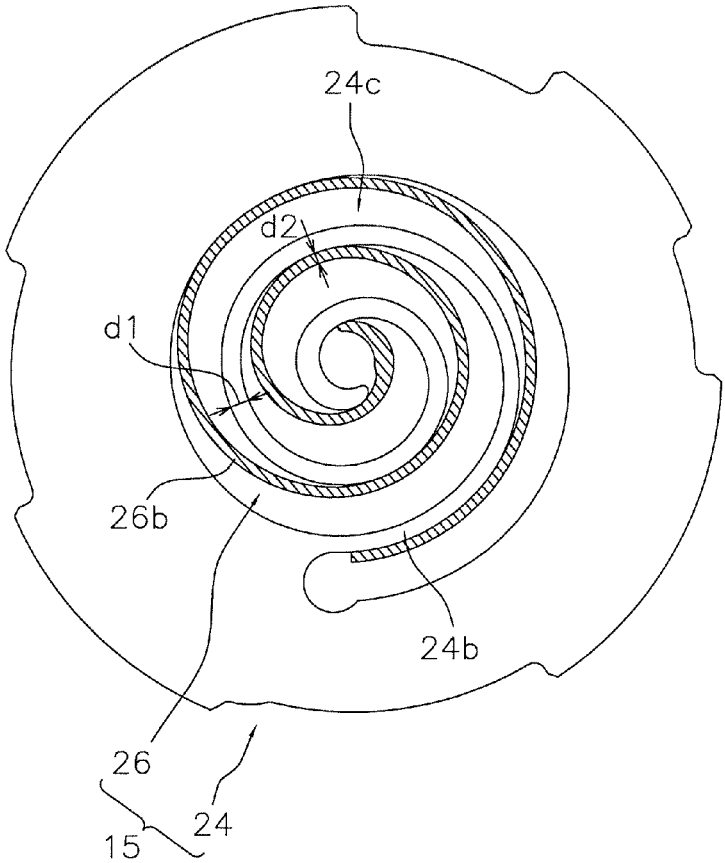
FIG. 2 is a cross-sectional view of a compression mechanism 15 along the line II-II in FIG. 1.
FIG. 3 is a table showing surface pressure for seizing to occur, graphite area ratio, and hardness.

FIG. 2 shows a cross-sectional view of the compression mechanism 15 along the line II-II shown in FIG. 1. The compression mechanism 15 includes a fixed scroll 24 and a movable scroll 26 (See FIG. 1 and FIG. 2). The compression mechanism 15 compresses refrigerant. An example of the refrigerant is composed mostly of carbon dioxide.

The fixed scroll 24 includes a first plate portion 24*a* and a first scroll portion 24*b*. The first plate portion 24*a* is secured to an inner wall 11*a* of the casing 11. The first scroll portion 24*b* is attached to the lower side of the first plate portion 24*a* (See FIG. 1). The first scroll portion 24*b* extends in an involute shape, and forms a spiral channel 24*c* between its involuted walls (See FIG. 2). The first plate portion 24*a* is a fixing member which holds the first scroll portion 24*b*.

The movable scroll 26 includes a second plate portion 26*a* and a second scroll portion 26*b*. The second scroll portion 26*b* is attached to the upper side of the second plate portion 26*a* (See FIG. 1). The second scroll portion 26*b* extends in an involute shape (See FIG. 2). The second plate portion 26*a* is another fixing member which holds the second scroll portion 26*b*.

The second scroll portion 26*b* fits in the spiral channel 24*c* of the fixed scroll 24 (See FIG. 2). The compression mechanism 15 has a compression space 40 between the first scroll portion 24*b* and the second scroll portion 26*b*. The compression space 40 is confined by the first plate portion 24*a* and the second plate portion 26*a*, and is used as a compression chamber which compresses refrigerant (See FIG. 1).

In the compression mechanism 15, the following first to third embodiments of the present invention describe respectively materials used for the fixed scroll 24 and the movable scroll 26, configurations of the first scroll portion 24*b* and the second scroll portion 26*b*, and a relief hole in the fixed scroll 24.

First Embodiment

In the compression mechanism 15 of the first embodiment, a material used for the fixed scroll 24 is different from that for the movable scroll 26.

More specifically, one of the fixed scroll 24 and the movable scroll 26 is a cast iron molding fabricated through semi-molten die casting (hereinafter, this molding is called "semi-molten die cast molding"). The semi-molten die cast molding has a tensile strength of greater than or equal to 600 $N/mm^2$ and less than or equal to 900 $N/mm^2$.

The other one of the fixed scroll 24 and the movable scroll 26 is a grey iron casting. The grey iron casting has a tensile strength of greater than or equal to 250 $N/mm^2$ and less than 300 $N/mm^2$. The tensile strength can ensure sufficient strength and stiffness of the grey iron casting to prevent deformation or rupture thereof. According to JIS (Japanese Industrial Standards), a grey iron casting that has a tensile strength of greater than or equal to 250 $N/mm^2$ and less than 300 $N/mm^2$ is a FC250.

FIG. 3 is a table showing surface pressure for seizing to occur (MPa), graphite area ratio (%), and hardness (HRB) of the compression mechanism 15. The surface pressure for seizing to occur represents the pressure which causes seizing to occur during a seizing test. The seizing test is implemented by sliding a pin-shaped molding (hereinafter, this molding is called "pin") on the surface of a disk-shaped molding (hereinafter, this molding is called "disk") based on a predetermined method. The predetermined method is as follows: soak a disk and a pin in a mixture of refrigerant R410A and ethereal oil (at 100 degrees centigrade); slide the pin at an average speed of 2.0 m/s; change a surface pressure between the pin and the disk; observe whether or not seizing occurs between the pin and the disk to measure the surface pressure which causes seizing to occur between the pin and the disk. The graphite area ratio represents an area occupied by graphite per unit area of the compression mechanism 15.

In FIG. 3, "slider A" is one of the fixed scroll 24 and the movable scroll 26, while "slider B" is the other. The graphite area ratio (%) and the hardness (HRB) of each of the slider A and B are shown respectively in FIG. 3. Hereinafter, a sum of the graphite area ratio of each of the slider A and B is called "total graphite area ratio" which is shown in the table of FIG. 3 (See the column "slider A+slider B").

FIG. 3 shows a seizing test result between a pin-shaped semi-molten die cast molding and a disk-shaped grey iron casting (See the row "semi-molten die cast molding/FC250"). For comparison, FIG. 3 also shows seizing test results for pins and disks made of the same materials. More specifically, FIG. 3 shows a seizing test result between a pin-shaped grey iron casting (FC250) and a disk-shaped grey iron casting (FC250) (See the row "FC250s"), and a seizing test result between a pin-shaped semi-molten die cast molding and a disk-shaped semi-molten die cast molding (See the row "semi-molten die cast moldings").

As shown in FIG. 3, the "semi-molten die cast molding/FC250" test result is as follows: the surface pressure for seizing to occur is 152 MPa; the total graphite area ratio is 10% to 20%; the graphite area ratio of the slider A is 2% to 6%; the graphite area ratio of the slider B is 8% to 14%; the hardness of the slider A is HRB90 to HRB100; and the hardness of the slider B is HRB90 to HRB100. In this case, the slider A is the semi-molten die cast molding, and the slider B is the grey iron casting (FC250).

As shown in FIG. 3, the "FC250s" test result is as follows: the surface pressure for seizing to occur is 169 MPa; the total graphite area ratio is 28%; the graphite area ratios of the slider A and slider B are both 14%; the hardness of the slider A and slider B are both HRB93.

As shown in FIG. 3, the "semi-molten die cast moldings" test result is as follows: the surface pressure for seizing to occur is 140 MPa; the total graphite area ratio is 8%; the graphite area ratios of the slider A and slider B are both 4.0%; the hardness of the slider A and slider B are both HRB98.

FIG. 3 shows that the surface pressure for seizing to occur in the "semi-molten die cast molding/FC250" test is higher than that in the "semi-molten die cast moldings" test. The reason is presented as follows.

Figure 4:
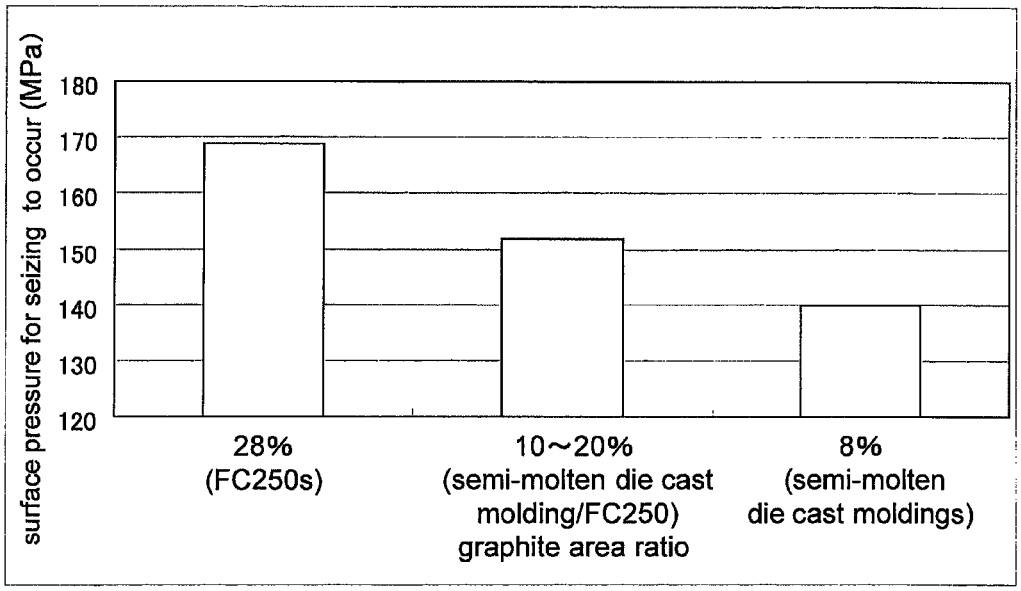
FIG. 4 is a graph showing the relationship between graphite area ratio and surface pressure for seizing to occur.

FIG. 4 is a graph showing the relationship between the total graphite area ratio and the surface pressure for seizing to occur. FIG. 4 suggests that a higher total graphite area ratio results in a higher surface pressure for seizing to occur. Accordingly, because the total graphite area ratio in the "semi-molten die cast molding/FC250" test is higher than that in the "semi-molten die cast moldings" test, their surface pressures for seizing to occur also show a similar trend.

The "semi-molten die cast molding/FC250" test shows that the graphite area ratio of the grey iron casting (FC250) is 8% to 14% which is notably higher than that of the semi-molten die cast molding, 2% to 6%. The remarkable difference of the graphite area ratio between the pin and the disk will be one of the factors that result in the increase of the surface pressure for seizing. The semi-molten die cast molding needs to have a graphite area ratio of at least 2% in order to prevent seizing.

Consequently, the compression mechanism 15 according to the first embodiment can easily prevent seizing between the fixed scroll 24 and the movable scroll 26, compared to a compression mechanism which includes a fixed scroll and a movable scroll, both of which are semi-molten die cast moldings.

Additionally, the compression mechanism 15 has a higher hardness, higher strength, and higher stiffness than a compression mechanism which includes a fixed scroll and a movable scroll, both of which are grey iron castings (FC250). Therefore, either the fixed scroll 24 or the movable scroll 26, whichever is the semi-molten die cast molding, can have the smaller thickness d2 (or d1) of the scroll portion 26*b* (or 24*b*) (See FIG. 2), and have the scroll portion 26*b* (or 24*b*) longer in height. This scroll results in downsizing the compression mechanism 15 without decreasing the compression efficiency. This scroll also results in increasing the intake capacity without changing the size of the compression mechanism 15.

In the compression mechanism 15, the graphite area ratio of the semi-molten die cast molding is preferably 4% to 6%. This is because the material workability of the semi-molten die cast molding will improve, due to the hardness thereof which can get near to HRB90 (more specifically, HRB90 to HRB95).

In addition, in the compression mechanism 15, the fixed scroll 24 is preferably the grey iron casting (FC250) and the movable scroll 26 is preferably the semi-molten die cast molding. In this case, because the semi-molten die cast molding has a higher strength and higher stiffness, the movable scroll 26 of the semi-molten die cast molding can have the thinner second scroll portion 26*b* and the thinner second plate portion 26*a*.

Consequently, the compression mechanism 15 can be downsized without changing the intake capacity. Alternatively, the compression mechanism 15 can also increase the intake capacity without changing its size. In addition, the movable scroll 26 can be lightweight, which reduces torque required to operate the movable scroll 26. The semi-molten die cast molding can reduce the cost of the compression mechanism 15.

The movable scroll 26 is placed and pushed against the fixed scroll 24. This prevents a gap between the fixed scroll 24 and the second scroll portion 26*b* of the movable scroll 26, whereby prevents a decrease of the compression efficiency.

In this case, the movable scroll 26 pushed against the fixed scroll 24 is the semi-molten die cast molding. This is because the movable scroll 26 has a high strength and high stiffness. That is, even if the movable scroll 26 is pushed against the fixed scroll 24, the second scroll portion 26*b* will not deform easily.

Second Embodiment

The second embodiment describes the configuration of the compression mechanism 15 described in the first embodiment.

Thickness of Scroll Portions

As described in the first embodiment, when any one of the fixed scroll 24 and the movable scroll 26 is the semi-molten die cast molding, that scroll 26 (or 24) has a high strength and high stiffness. In this case, the scroll 26 (or 24) becomes less prone to rupture and bending.

In addition, the scroll 26 (or 24) with high strength and high stiffness can have the scroll portion 26*b* (or 24*b*) with a small thickness d2 (or d1). However, while a semi-molten die cast molding has 2.4 to 3.6 times more strength than a FC250 casting does (based on "600 MPa/250 MPa to 900 MPa/250 MPa", where "600 MPa" and "900 MPa" are experimental values of strength for a semi-molten die cast molding), a semi-molten die cast molding has no more than 1.6 to 1.7 times more stiffness than a FC250 casting does (based on "175 GPa/110 GPa to 190 GPa/110 GPa", where "175 GPa" and "190 GPa" are experimental values of stiffness for a semi-molten die cast molding). Therefore, when the thickness d2 (or d1) is determined based on the strength so as to prevent rupture, the scroll portion 26*b* (or 24*b*) can be bent easily.

For this reason, a thickness ratio d2/d1 (or d1/d2) is calculated based on a Young's modulus ratio α. In this case, the thickness ratio d2/d1 (or d1/d2) is a ratio of the thickness d2 (or d1) of the scroll portion 26*b* (or 24*b*) of the semi-molten die cast molding to the thickness d1 (or d2) of the scroll portion 24*b* (or 26*b*) of the grey iron casting. The Young's modulus ratio α is a ratio of the Young's modulus of the semi-molten die cast molding to the Young's modulus of the grey iron casting.

For example, when the fixed scroll 24 is a grey iron casting and the movable scroll 26 is a semi-molten die cast molding, the thickness ratio d2/d1 is given a value calculated based on the Young's modulus ratio α, where d1 is the thickness of the first scroll portion 24*b* and d2 is the thickness of the second scroll portion 26*b*.

The Young's modulus ratio α can be about 1.6. The Young's modulus of the semi-molten die cast molding is preferably greater than or equal to 175 GPa and less than or equal to 190 GPa, so as to prevent a decrease of the compression efficiency caused by bending of the semi-molten die cast molding.

When the thickness d1 and d2 are determined through the thickness ratio d2/d1 (or d1/d2) calculated based on the Young's modulus ratio α, the amount of bending of the first scroll portion 24*b* can be almost equal to that of the second scroll portion 26*b*. Therefore, in the compression mechanism 15, the decrease of the compression efficiency caused by bending of the scroll portions 24*b* and 26*b* can be prevented.

In order to achieve a downsized compression mechanism 15 while maintaining a high intake capacity by decreasing the thickness d2 (or d1) of the scroll portion of the semi-molten die cast molding, the thickness ratio d2/d1 (or d1/d2) needs to be less than or equal to the reciprocal of the Young's modulus ratio α (that is, 1/α).

When the fixed scroll 24 is a semi-molten die cast molding and the movable scroll 26 is a grey iron casting, the thickness ratio d1/d2 needs to be calculated based on the Young's modulus ratio α, where d1 is the thickness of the first scroll portion 24*b* and d2 is the thickness of the second scroll portion 26*b*. In this case, as described above, the amount of bending of the first scroll portion 24*b* can become almost equal to that of the second scroll portion 26*b*.

Configurations of Scroll Portions

Figure 5:
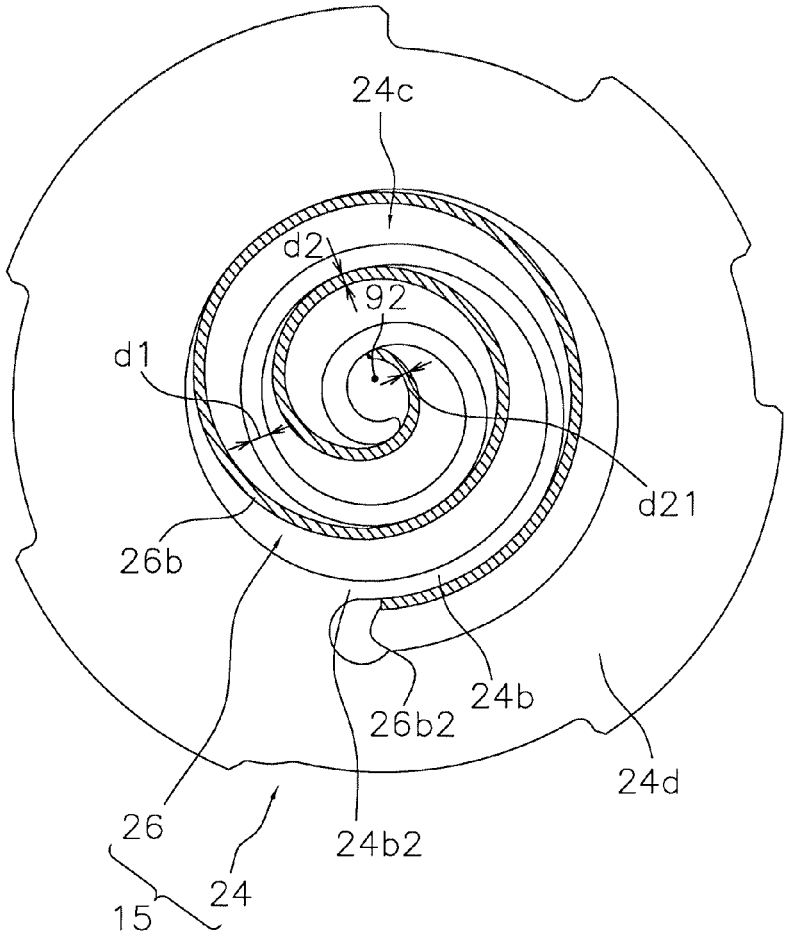
FIG. 5 is a cross-sectional view of a compression mechanism 15 whose configuration is different from that of FIG. 2.

FIG. 5 shows another configuration of the compression mechanism 15 which is different from that shown in FIG. 2. FIG. 5 is a cross-sectional view along the line II-II in FIG. 1.

As described in the first embodiment, when one of the fixed scroll 24 and the movable scroll 26 is a semi-molten die cast molding, that scroll can have the small thickness d2 (or d1) of the scroll portion 26*b* (or 24*b*). Considering the bending of the scroll portion 26*b* (or 24*b*) during the operation of the compression mechanism 15, a ratio h2/d2 (or h1/d1) is preferably greater than or equal to 13 and less than or equal to 19, where h2 (or h1) is the height of the scroll portion 26*b* (or 24*b*) from the plate portion 26*a* (or 24*a*), and d2 (or d1) is the thickness of the scroll portion 26*b* (or 24*b*).

In the fixed scroll 24, an end portion 24*b*2 of the outmost wall of the first scroll portion 24*b* is supported by another portion 24*d* of the fixed scroll 24. Therefore, even if the fixed scroll 24 is a semi-molten die cast molding and has the small thickness d1, the material workability of the first scroll portion 24*b* would not worsen easily.

On the other hand, in the movable scroll 26, an end portion 26*b*2 of the outmost wall of the second scroll portion 26*b* is, unlike the end portion 24*b*2 of the fixed scroll 24, not supported. Therefore, when the second scroll portion 26*b*, especially the end portion 26*b*2, is fabricated, its material workability can worsen easily due to the bending thereof.

In addition, while a semi-molten die cast molding has 2.4 to 3.6 times more strength than a FC250 casting does (based on "600 MPa/250 MPa to 900 MPa/250 MPa"), the semi-molten die cast molding has no more than 1.6 to 1.7 times more stiffness than a FC250 casting does (based on "175 GPa/110 GPa to 190 GPa/110 GPa"). Therefore, when the thickness d2 (or d1) is determined based on the strength so as to prevent rupture, the scroll portion 26*b* (or 24*b*) can be bent easily.

For this reason, when the movable scroll 26 is the semi-molten die cast molding, a portion near the end portion 26*b*2 of the outmost wall of the second scroll portion 26*b* needs to be thicker than the other portions before fabrication. In this case, the second scroll portion 26*b* can be fabricated with great precision.

Figure 6:
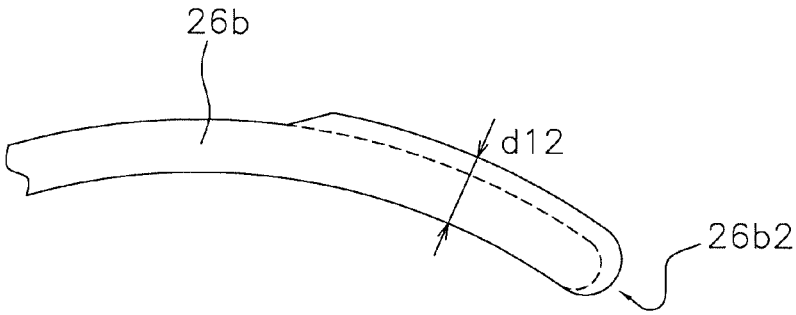
FIG. 6 is a schematic view of a scroll portion, the outmost wall of which has a thick end.
Figure 7:
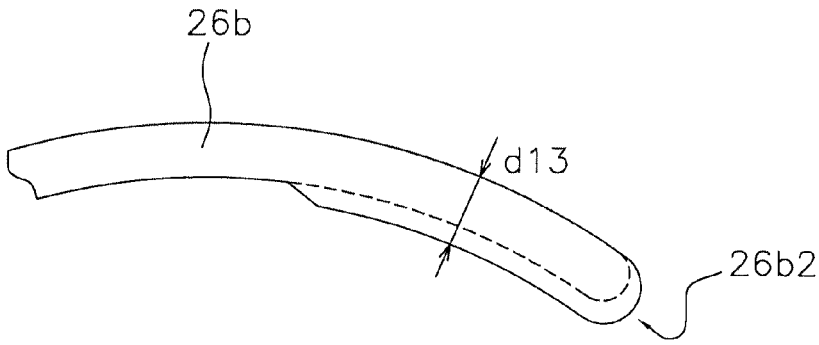
FIG. 7 is a schematic view of a scroll portion, the outmost wall of which has a thick end.
Figure 8:
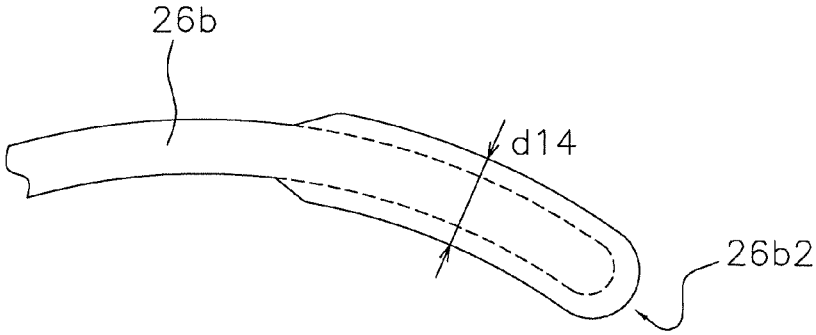
FIG. 8 is a schematic view of a scroll portion, the outmost wall of which has a thick end.

Each of FIG. 6, FIG. 7 and FIG. 8 shows a configuration of a pre-fabricated second scroll portion 26*b*. Each of FIG. 6, FIG. 7 and FIG. 8 shows only a portion in the proximity of the end portion 26*b*2 of the outmost wall of the second scroll portion 26*b* of the movable scroll 26.

In FIG. 6, the portion in the proximity of the end portion 26*b*2 gets thicker on the outer surface than the other portions of the second scroll portion 26*b* (See thickness d12). In this case, the portion in the proximity of the end portion 26*b*2 is fabricated as follows.

First, a finishing process is performed to the inner surface of the second scroll portion 26*b*. In this case, the second scroll portion 26*b* does not bent easily, because the portion in the proximity of the end portion 26*b*2 gets thicker on the outer surface. Therefore, the finishing process can be performed easily.

After that, the thick portion is trimmed to finish the process for the portion in the proximity of the end portion 26*b*2. In FIG. 6, the dashed line indicates the shape of the second scroll portion 26*b* after trimming.

In FIG. 7, the portion in the proximity of the end portion 26*b*2 gets thicker on the inner surface than the other portions of the second scroll portion 26*b* (See thickness d13). In this case, the portion in the proximity of the end portion 26*b*2 is fabricated as follows.

First, a finishing process is performed to the outer surface of the second scroll portion 26*b*. In this case, the second scroll portion 26*b* does not bent easily, because the portion near the end portion 26*b*2 gets thicker on the inner surface. Therefore, the finishing process can be done easily.

After that, the thick portion is trimmed to finish the process for the portion near the end portion 26*b*2. In FIG. 7, the dashed line indicates the shape of the second scroll portion 26*b* after trimming.

In FIG. 8, the portion in the proximity of the end portion 26*b*2 gets thicker on both the outer and inner surfaces than the other portions of the second scroll portion 26*b* (See thickness d14). In this case, the portion in the proximity of the end portion 26*b*2 is fabricated as follows.

First, a roughening process and a finishing process are performed to the outer or inner surface of the second scroll portion 26*b* in this order. For example, when the rough process and the finishing process are performed to the inner surface, the second scroll portion 26*b* does not bent easily due to these processes, because the portion in the proximity of the end portion 26*b*2 gets thicker on the outer surface. Therefore, the inner surface can be processed easily.

After that, the thick portion on the outside is trimmed to finish the process. The similar process can be performed when the roughening process and the finishing process are performed to the outer surface. In FIG. 8, the dashed line indicates the shape of the second scroll portion 26*b* after trimming.

Figure 9:
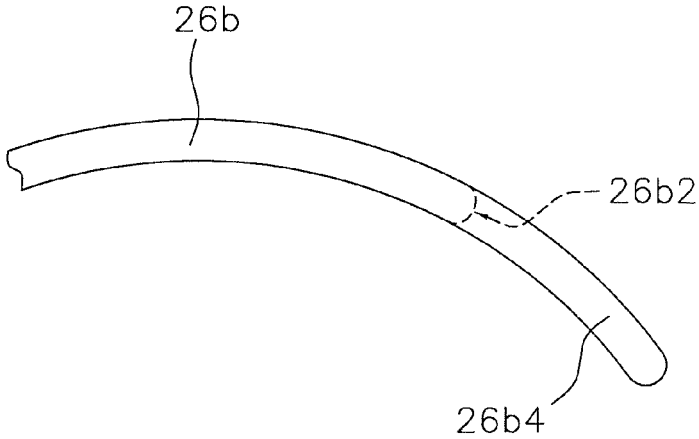
FIG. 9 is a schematic view of a movable scroll with an extended portion.

As shown in FIG. 9, the end portion 26*b*2 may be formed longer than the above end portions. More specifically, the movable scroll 26 may include further an extended portion 26*b*4. The extended portion 26*b*4 extends from the end portion 26*b*2 of the outmost wall of the second scroll portion 26*b*, and does not engage with the first scroll portion 24*b* of the fixed scroll 24.

In the movable scroll 26 shown in FIG. 9, the end portion 26*b*2 of the outmost wall of the second scroll portion 26*b* has a high strength and high stiffness due to the extended portion 26*b*4. Therefore, the second scroll portion 26*b* can be free from deformation during fabrication.

After the second scroll portion 26*b* is fabricated, the extended portion 26*b*4 may be left unprocessed, or may be cut out. However, when the extended portion 26*b*4 is left unprocessed, the following problem can occur.

Figure 10:
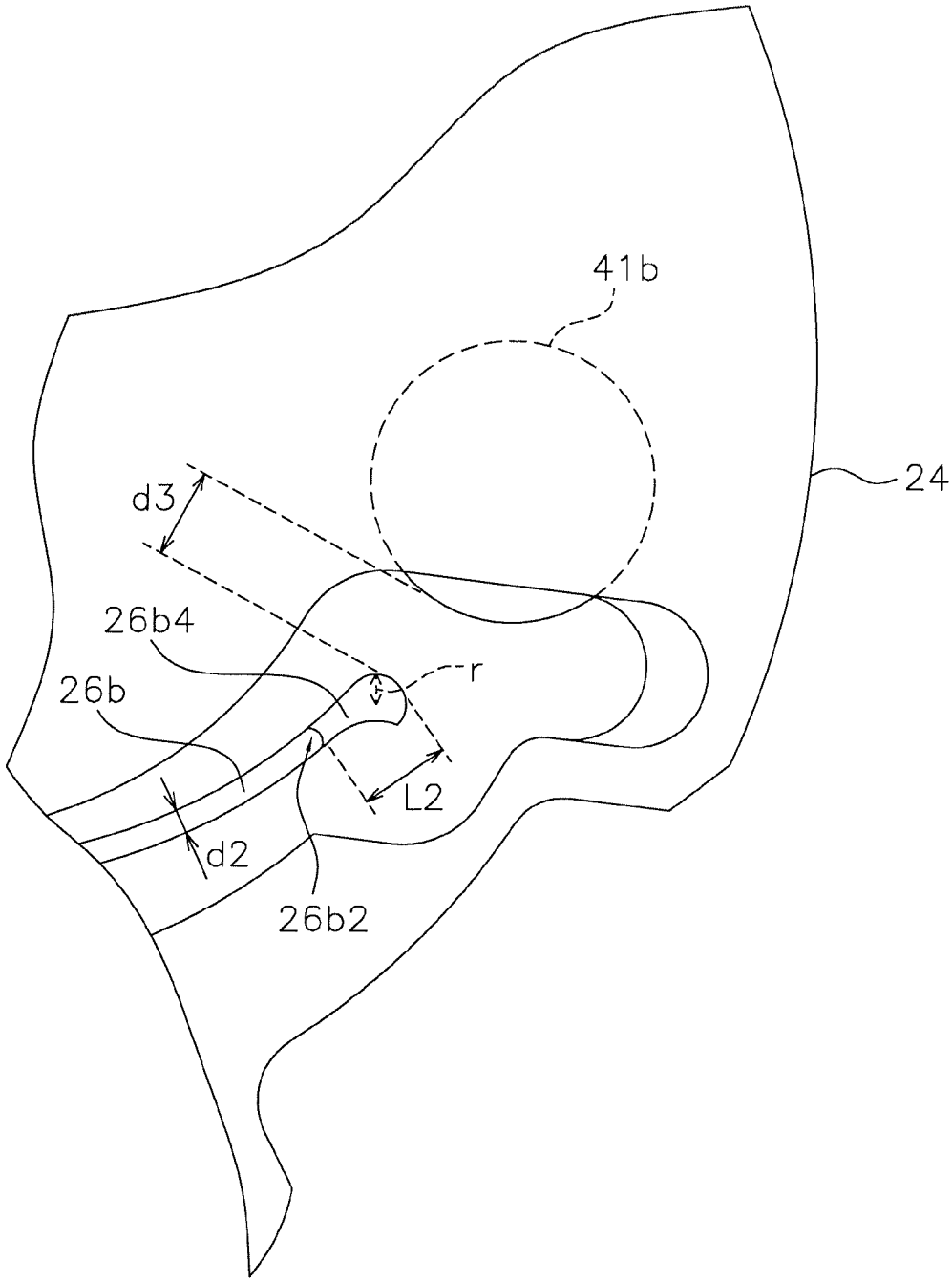
FIG. 10 is a schematic view of a movable scroll with an extended portion.
Figure 11:
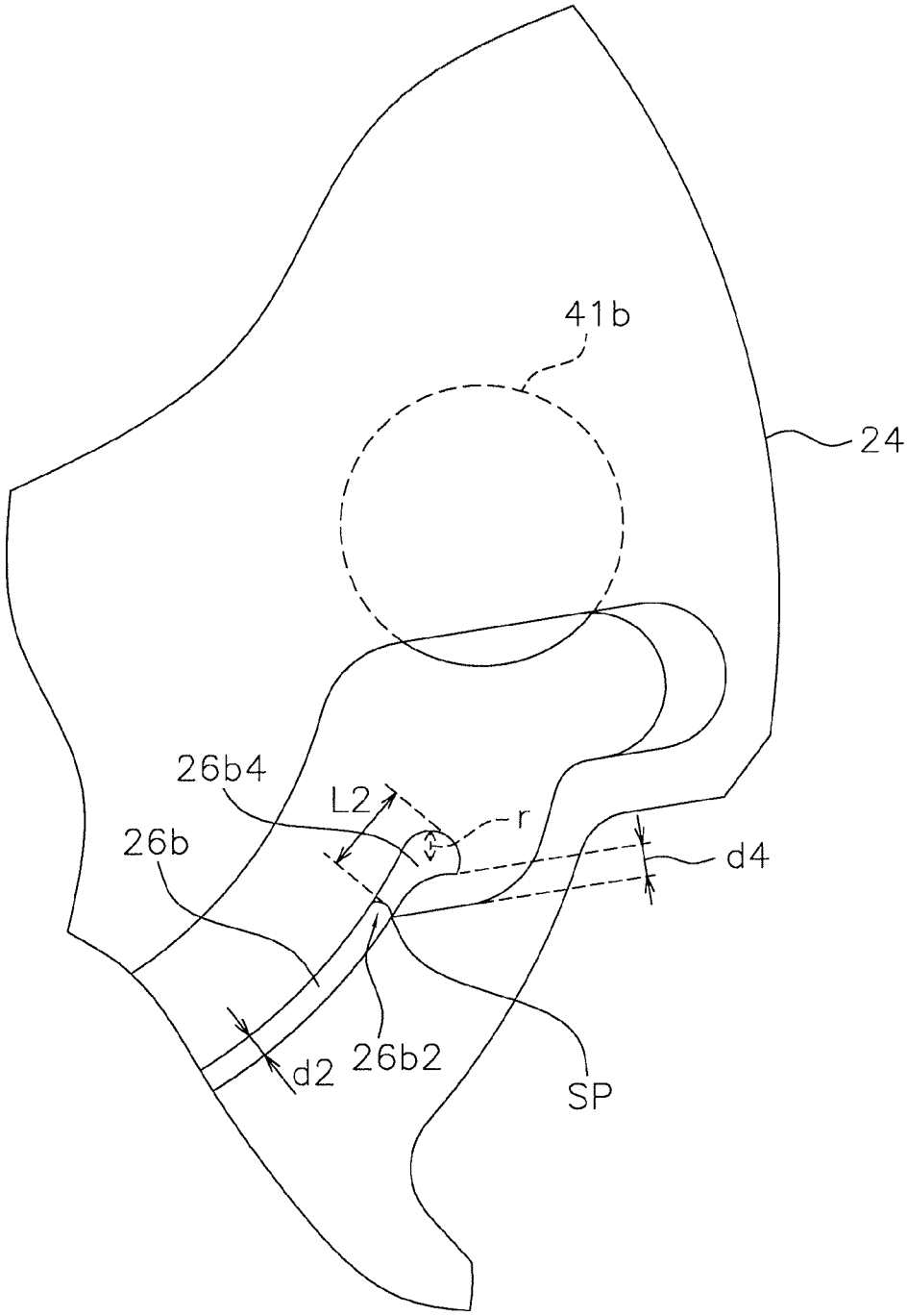
FIG. 11 is a schematic view of a movable scroll with an extended portion.

As shown in FIG. 10 and FIG. 11, in the proximity of the end portion 26*b*2 of the outmost wall of the second scroll portion 26*b*, the first plate portion 24*a* of the fixed scroll 24 has a through hole 41*b* through which refrigerant is drawn (hereinafter, the through hole is called "drawing hole"). Therefore, when the extended portion 26*b*4 covers the drawing hole 41*b* during the operation of the compression mechanism 15, a loss of the suction pressure will occur, which decreases the compression efficiency.

For this reason, the extended portion 26*b*4 is designed to be placed not to cover the drawing hole 41*b* during the operation of the compression mechanism 15. As shown in FIG. 10 and FIG. 11, when a side surface of the extended portion 26*b*4 has a shape of an arc with a radius of r, the extended portion 26*b*4 is designed as follows.

When the extended portion 26*b*4 gets closest to the drawing hole 41*b* during the operation of the compression mechanism 15, a distance d3 between the extended portion 26*b*4 and the drawing hole 41*b* needs to be greater than or equal to the radius r (See FIG. 10).

In addition, the arc-shaped side surface of the extended portion 26*b*4 is placed away from a sealing point SP by a distance d4 which is greater than or equal to the radius r (See FIG. 11), where the sealing point SP is an extreme point at which the fixed scroll 24 is in contact with the second scroll portion 26*b* of the movable scroll 26.

Figure 12:
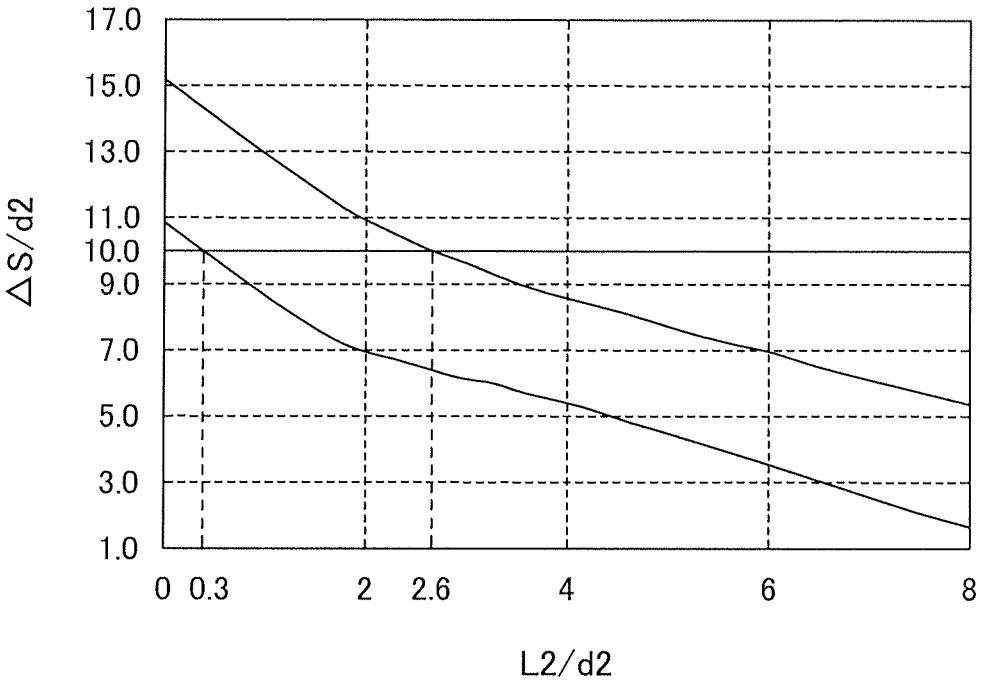
FIG. 12 is a graph showing the relationship between the ratio of bending (ΔS) to thickness (d2) and the ratio of length (L2) to thickness (d2).

FIG. 12 is a graph showing the relationship between the ratio of ΔS to d2 (ΔS/d2) and the ratio of L2 to d2 (L2/d2), where ΔS is the amount of bending of the second scroll portion 26*b* at the sealing point SP, d2 is the thickness of the second scroll portion 26*b*, and L2 is the length of the extended portion 26*b*4.

The ratio ΔS/d2 is preferably less than or equal to 10. This allows a gap to be made between the first scroll portion 24*b* of the fixed scroll 24 and the second scroll portion 26*b* of the movable scroll 26, so as not to decrease the compression efficiency. The gap can reduce the interference between the first scroll portion 24*b* and the second scroll portion 26*b*, whereby decreases the noise and the chance of rupture.

Therefore, considering the relationship between the length L2 of the extended portion 26*b*4 and the thickness d2 of the second scroll portion 26*b*, the ratio L2/d2 is preferably greater than or equal to 0.3. This case is especially preferable when the above ratio h2/d2 is 13, which is the lower limit of the preferable range of 13 to 19 (See FIG. 12). On the other hand, the ratio L2/d2 is preferably greater than or equal to 2.6 when the ratio h2/d2 is 19, which is the upper limit of the preferable range (See FIG. 12).

The height of the extended portion 26*b*4 may be shorter than the height h2 of the second scroll portion 26*b*.

Third Embodiment

The third embodiment describes a relief hole cut in the fixed scroll 24, with regard to the compression mechanism 15 which has the fixed scroll 24 of the grey iron casting (FC250) and the movable scroll 26 of the semi-molten die cast molding.

Figure 13:
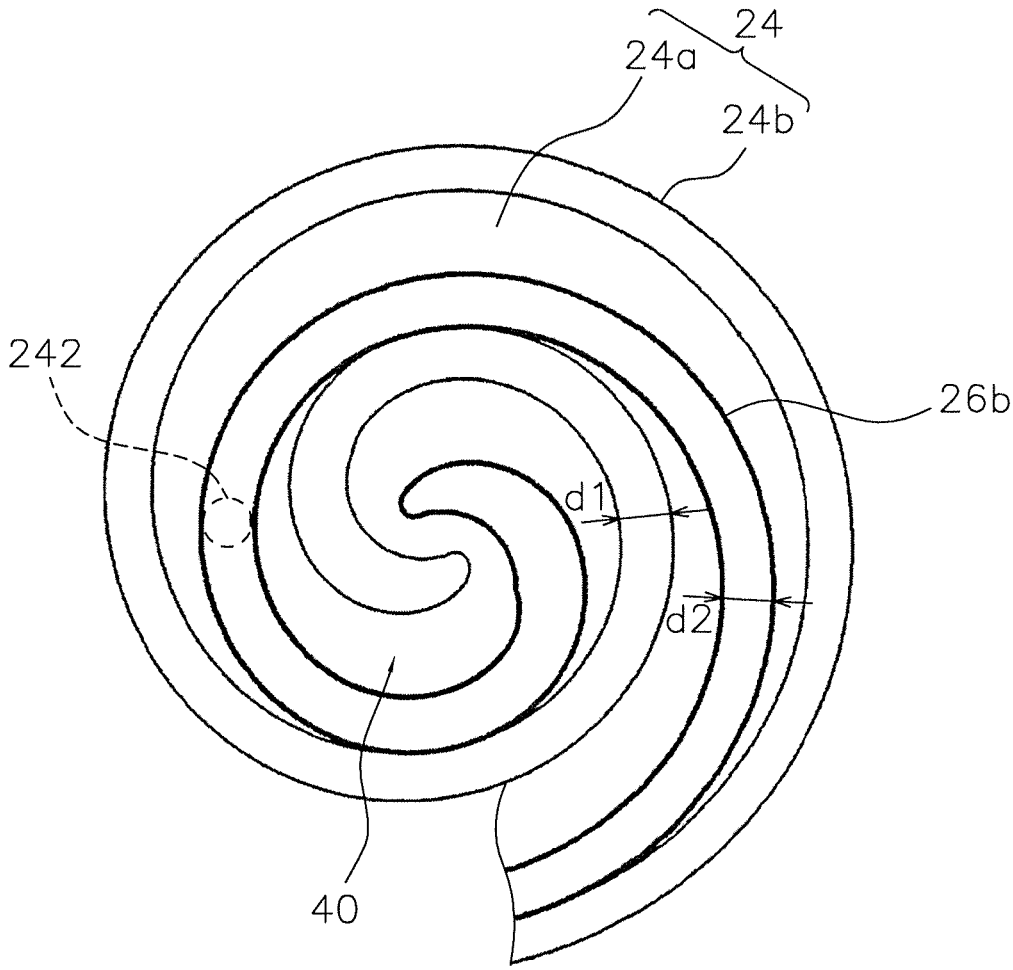
(Prior Art) FIG. 13
FIG. 13 is a schematic view of a conventional compression mechanism with a relief hole.

First of all, a conventional relief hole will be described with reference to FIG. 13. A relief hole 242 is formed in the fixed scroll 24. More specifically, the relief hole 242 is formed in the first plate portion 24*a*, and is open between the involuted walls of the first scroll portion 24*b*. The relief hole 242 connects the compression space 40 to a discharge space 45 (See FIG. 1) which will be described later in "Embodiment of scroll compressor". The discharge space 45 is located on the opposite side of the movable scroll 26 across the first plate portion 24*a* of the fixed scroll 24 (See FIG. 1).

Conventionally, both the fixed scroll 24 and the movable scroll 26 have been formed of the grey iron casting (FC250), where the thickness d1 of the first scroll portion 24*b* is substantially equal to the thickness d2 of the second scroll portion 26*b*. In this case, the thickness d1 and d2 need to be sufficiently large to improve strength and stiffness of the scroll portions 24*b* and 26*b*.

In addition, the diameter of the relief hole 242 conventionally needs to be smaller than or equal to the thickness d2 of the second scroll portion 26*b* so as not to connect the compression spaces 40 on two sides of the second scroll portion 26*b* to each other via the relief hole 242. However, because the thickness d2 has been large, the diameter of the relief hole 242 has also been large. Therefore, refrigerant passes through the relief hole 242 easily.

Figure 14:
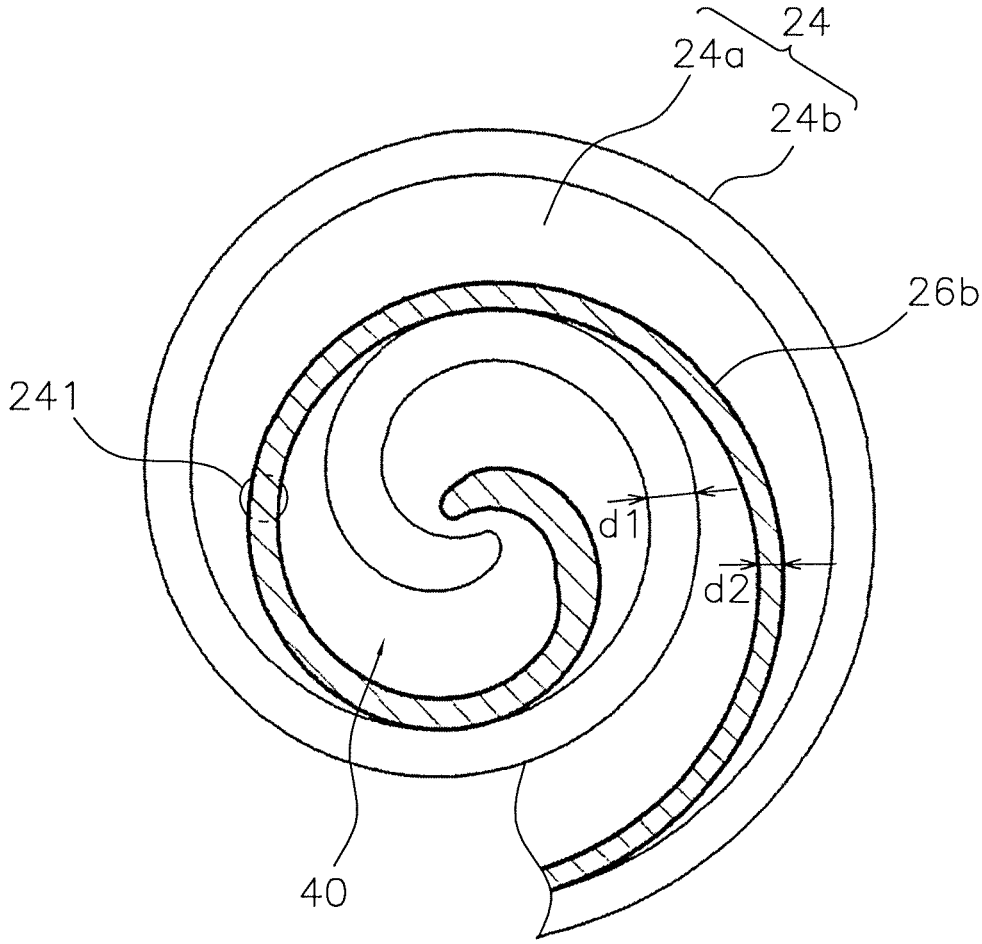
(Prior Art) FIG. 14
FIG. 14 is a schematic view of a conventional compression mechanism with a thin scroll portion.

However, as shown in FIG. 14, when the movable scroll 26 is a semi-molten die cast molding, the thickness d2 of the second scroll portion 26*b* is small, and the cross-sectional area of the relief hole 241 is equal to that of the conventional relief hole 242 (See FIG. 13), the two spaces separated by the second scroll portion 26*b* in the compression spaces 40 in the compression mechanism 15 will connect to each other, which decreases the compression efficiency.

Figure 15:
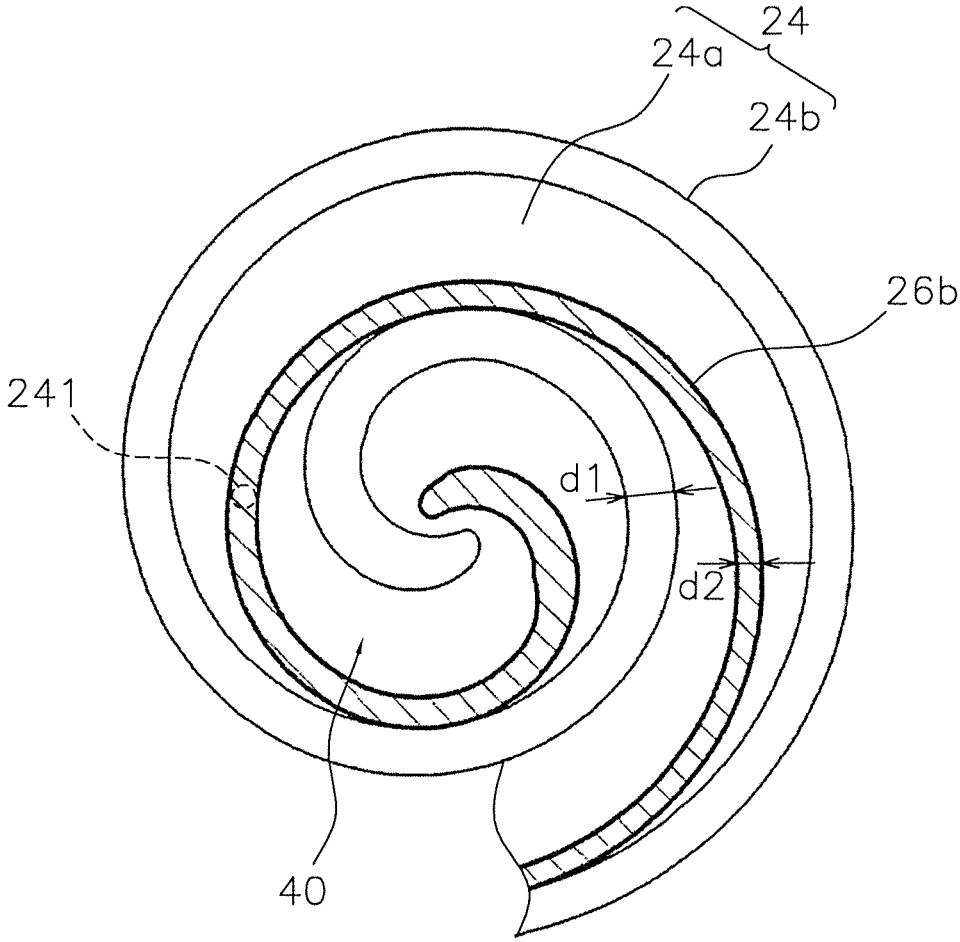
(Prior Art) FIG. 15
FIG. 15 is a schematic view of a conventional compression mechanism with a narrower relief hole.

In addition, as shown in FIG. 15, when the cross-sectional area of the relief hole 241 is too small, refrigerant will not pass through the relief hole 241 smoothly.

Figure 16:
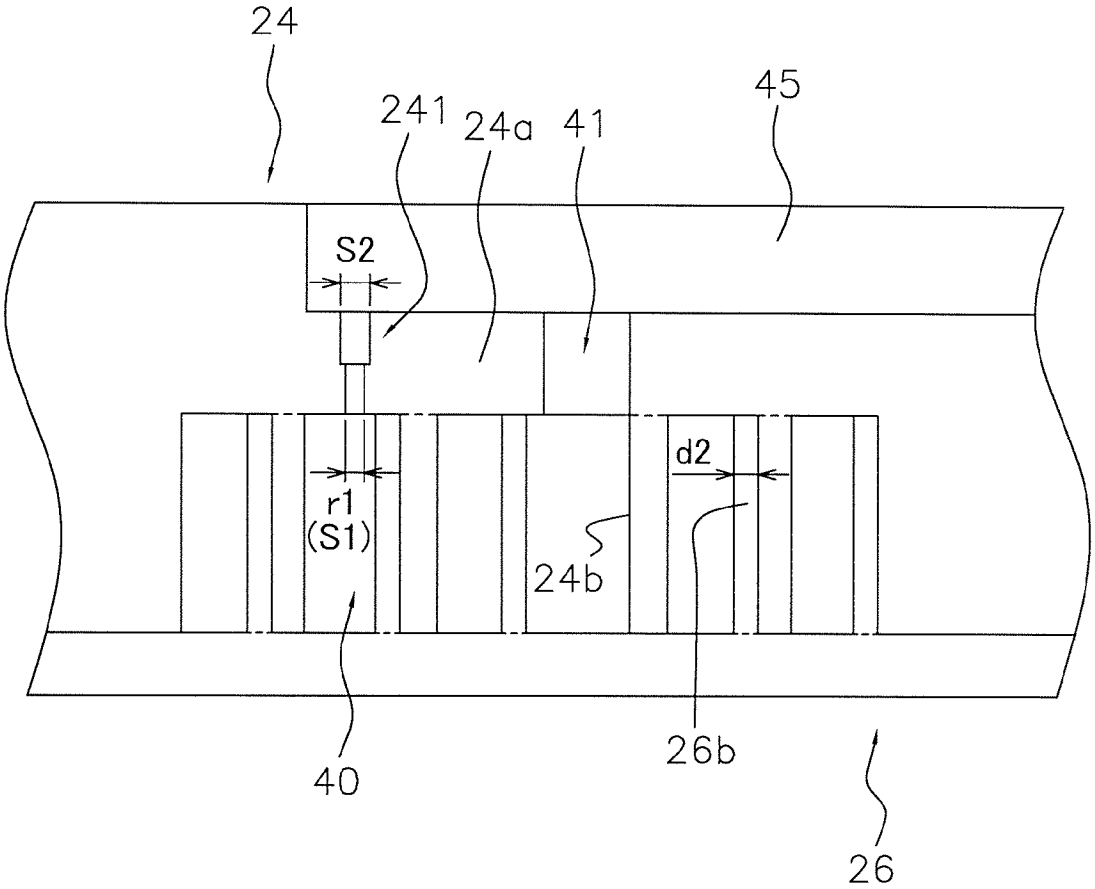
FIG. 16 is a schematic view of a relief hole 241 used in a compression mechanism 15.

FIG. 16 is a schematic view of the relief hole 241 applicable in the compression mechanism 15 described in the first and second embodiments. FIG. 16 is a longitudinal cross-sectional view of the compression mechanism 15 along the arrow 91 shown in FIG. 1.

In the relief hole 241, the diameter r1 of the opening on the side of the compression space 40 is less than or equal to the thickness d2 of the second scroll portion 26*b* of the movable scroll 26 (See FIG. 16). In the relief hole 241, the cross-sectional area S2 of the opening on the side of the discharge space 45 is larger than the cross-sectional area 51 of the opening on the side of the compression spaces 40 (See FIG. 16).

In this case, even if the thickness d2 of the second scroll portion 26*b* of the movable scroll 26 is small, the two spaces separated by the second scroll portion 26*b* in the compression spaces 40 will not connect to each other via the relief hole 241. Therefore, a decrease of the compression efficiency can be prevented.

In addition, because the cross-sectional area S2 of the opening of the relief hole 241 on the side of the discharge space 45 is large, refrigerant can flow into the discharge space 45 via the relief hole 241 smoothly. Therefore, the compressed refrigerant will be discharged efficiently.

The relief hole 241 shown in FIG. 16 is a combination of two holes of different cross-sectional areas. However, the relief hole 241 may be one of the relief holes 241 shown in FIGS. 17 to 21.

Figure 17:
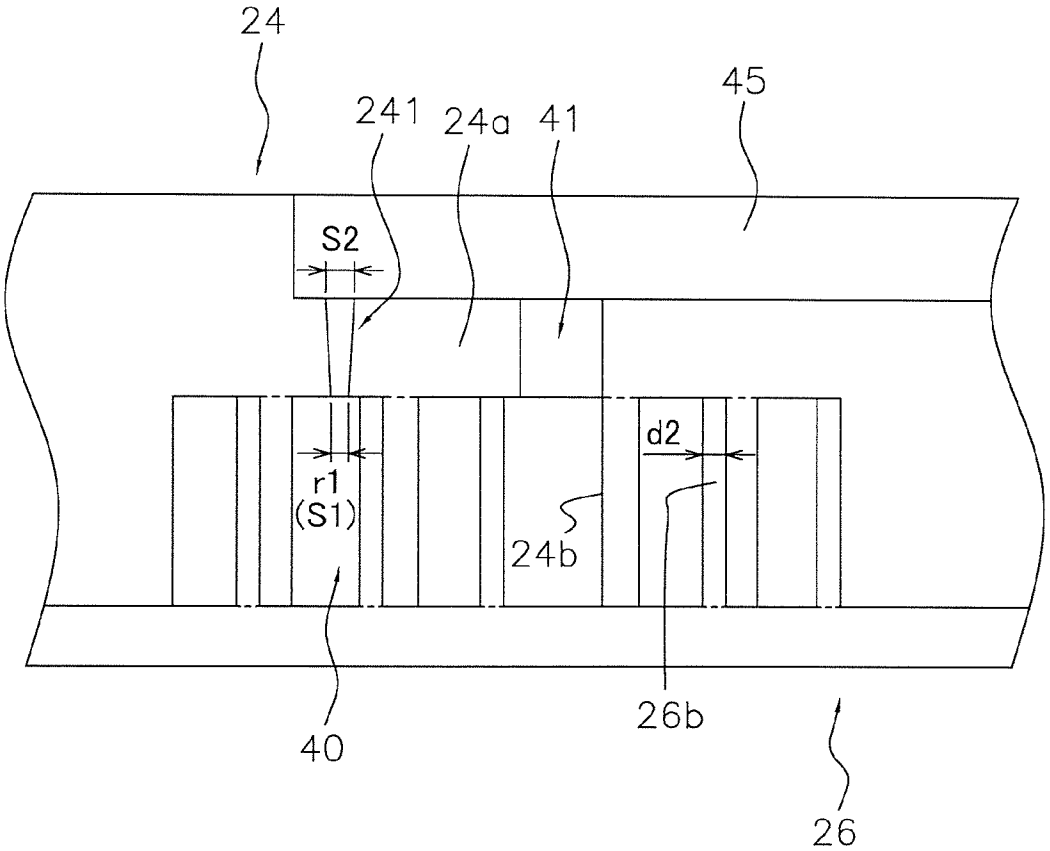
FIG. 17 is a schematic view of a relief hole 241 used in a compression mechanism 15.

FIG. 17 is a longitudinal cross-sectional view of the compression mechanism 15 along the arrow 91 shown in FIG. 1. In FIG. 17, the cross-sectional area of the relief hole 241 grows gradually from the compression space 40 to the discharge space 45. The relief hole 241 shown in FIG. 17 has similar effects as the relief hole 241 shown in FIG. 16.

Figure 18:
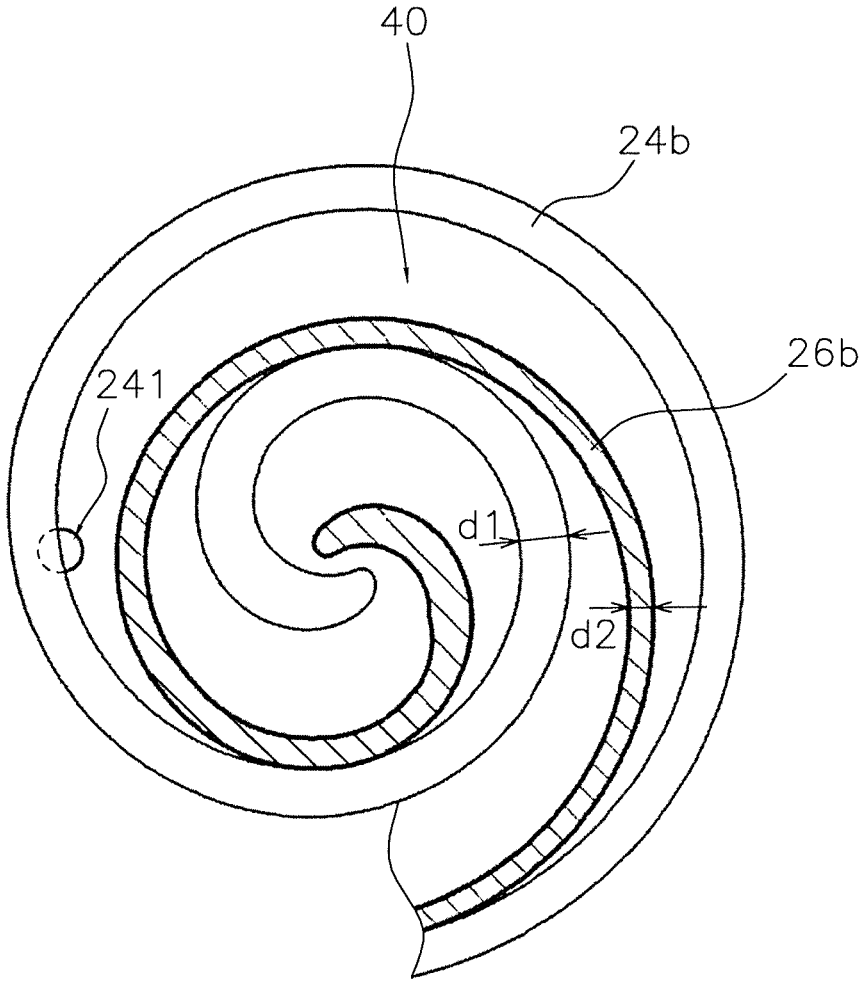
FIG. 18 is a schematic view of a relief hole 241 used in a compression mechanism 15.
Figure 19:
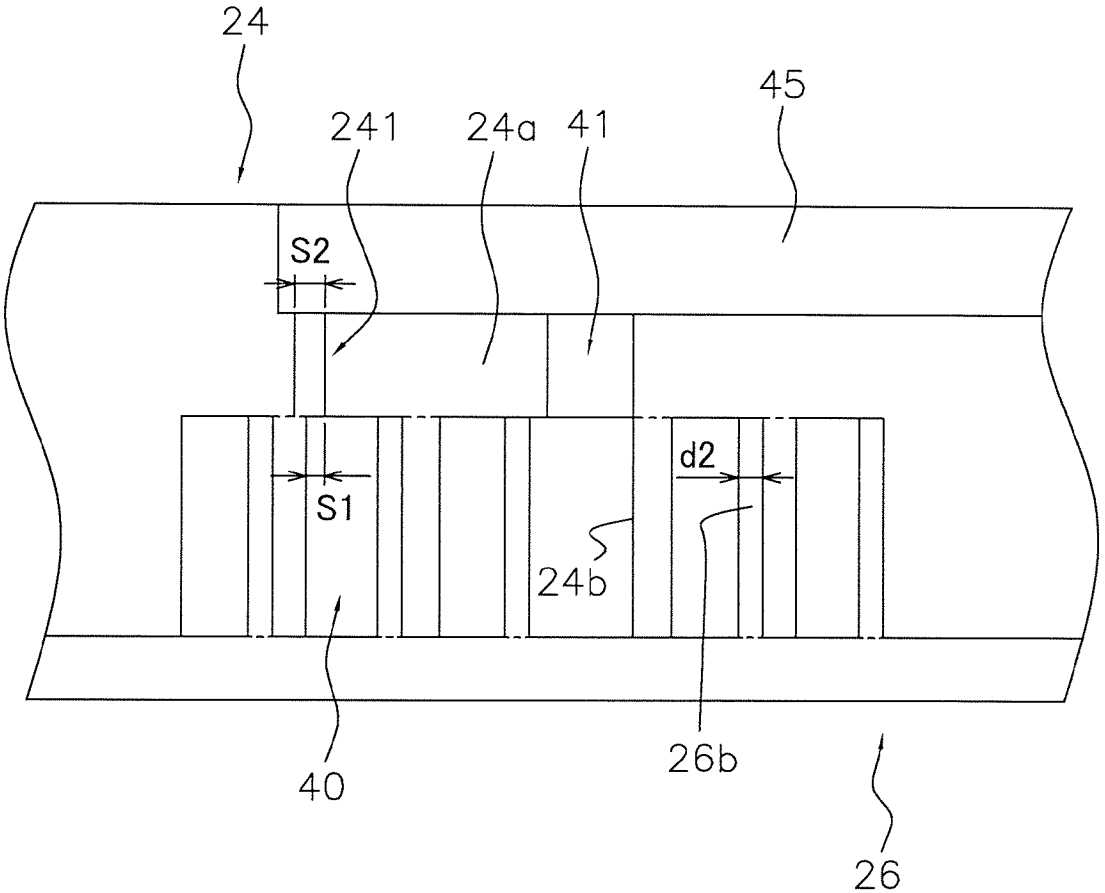
FIG. 19 is a cross-sectional view of a relief hole along the arrow 91 in FIG. 1.

FIG. 18 is a cross-sectional view of the compression mechanism 15 along the line II-II in FIG. 1. FIG. 19 is a longitudinal cross-sectional view of the compression mechanism 15 shown in FIG. 18 along the arrow 91. In FIG. 18 and FIG. 19, the relief holes 241 have substantially the same size as the conventional relief hole 242 (See FIG. 13). However, the first scroll portion 24*b* of the fixed scroll 24 covers a portion of the relief hole 241 (See FIG. 18). In other words, as viewed from the movable scroll 26, the relief hole 241 is covered partly by the first scroll portion 24*b* of the fixed scroll 24.

In this relief hole 241, the cross-sectional area S1 of the opening on the side of the compression spaces 40 is small, and the cross-sectional area S2 of the opening on the side of the discharge space 45 is large (See FIG. 19). Therefore, the relief hole 241 shown in FIG. 19 has similar effects as the relief hole 241 shown in FIG. 16.

Figure 20:
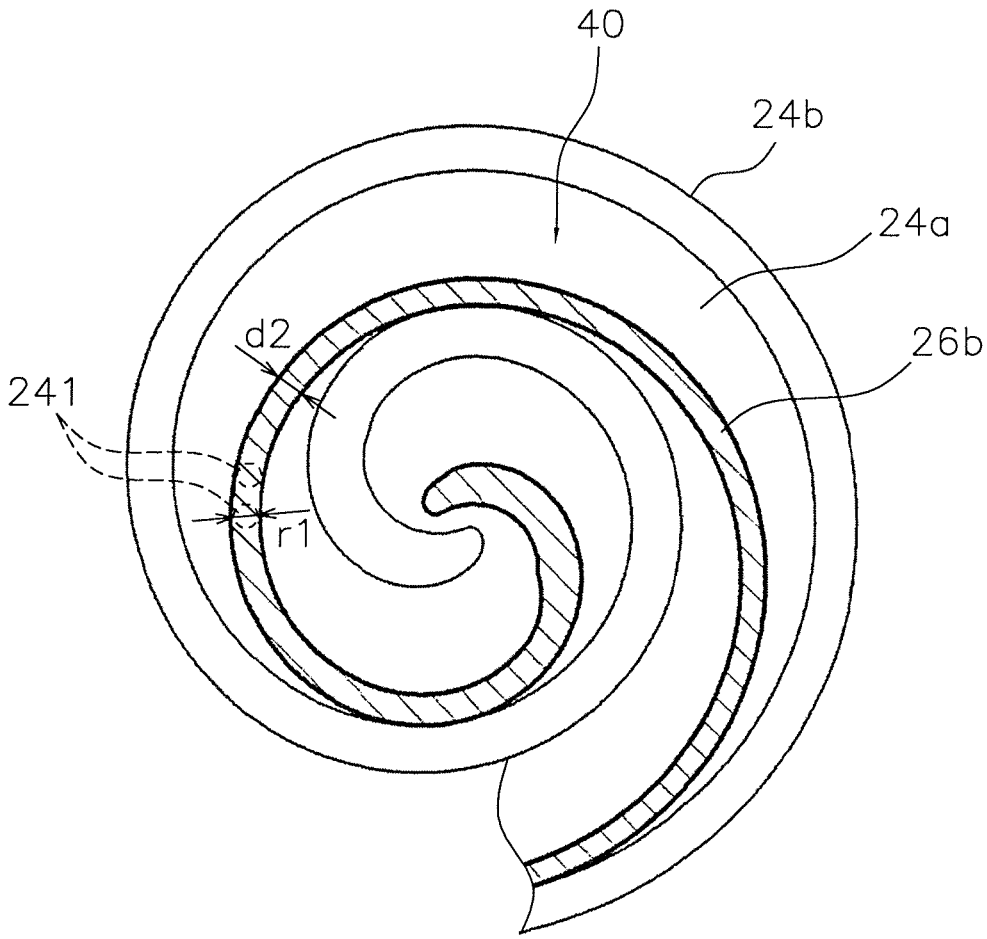
FIG. 20 is a schematic view of a compression mechanism with a plurality of relief holes 241 formed in a plate portion 24*a*.
Figure 21:
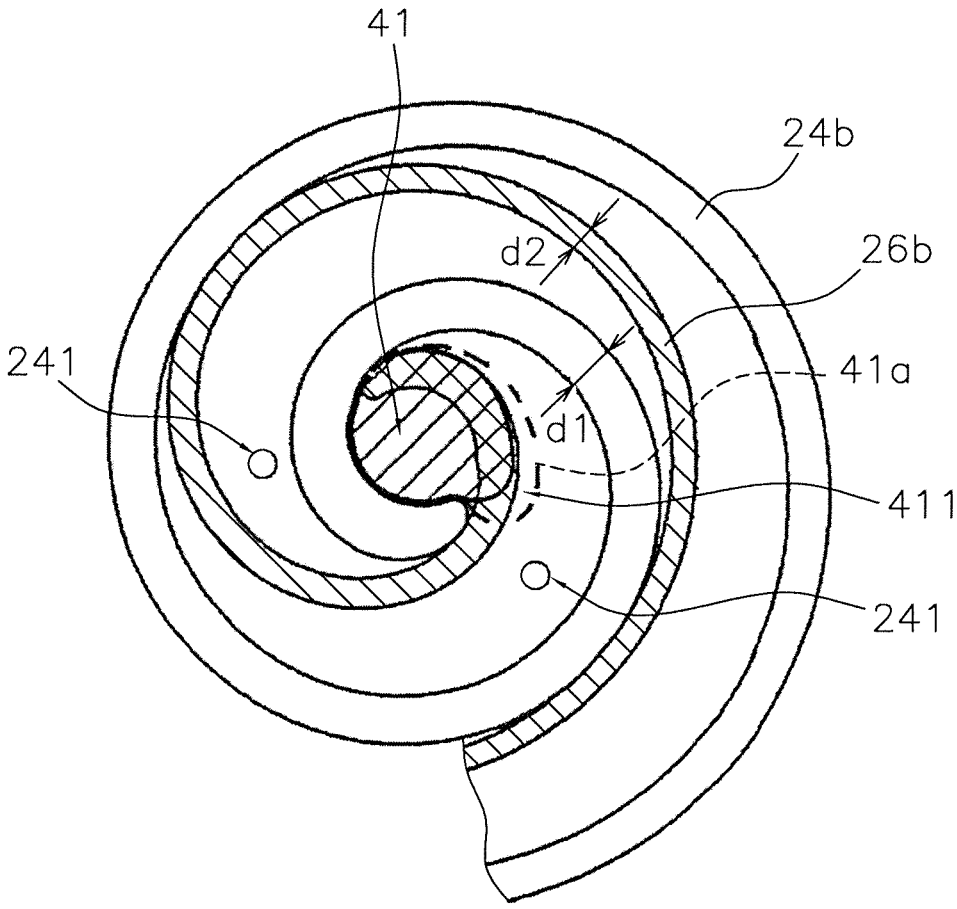
FIG. 21 is a schematic view of a compression mechanism with a plurality of relief holes 241 formed in a plate portion 24*a*.

In FIG. 20 and FIG. 21, a plurality of relief holes 241 are formed in the first plate portion 24*a*. Each of the relief holes 241 has a diameter r1 smaller than the thickness d2 of the second scroll portion 26*b*. For example, the first plate portion 24*a* may have the relief holes which have the shape of ellipsis.

In FIG. 21, a discharge hole 41 in the present embodiment is drawn in solid lines, and a conventional discharge hole 41*a* is drawn in dashed lines. The cross-sectional area of the discharge hole 41 is smaller than that of the conventional discharge hole 41*a*. This is a design modification which is resulted from the small thickness d2 of the second scroll portion 26*b*.

When the cross-sectional area of the discharge hole 41 decreases, the amount of refrigerant discharged through the discharge hole 41 decreases. However, as shown in FIG. 21, the plurality of relief holes 241 formed in the first plate portion 24*a* can be used as auxiliary discharge holes. Therefore, a decrease of discharged refrigerant can be prevented.

More specifically, in this case, both the refrigerant discharged from the relief holes 241 and that from the discharge hole 41 flow into the same space. In the present embodiment, both the refrigerant discharged from the relief holes 241 and that from the discharge hole 41 are guided into the discharge space 45 (See FIG. 1 and FIG. 19). Therefore, the refrigerant discharged from the relief holes 241 can also be used as the refrigerant compressed by the compression mechanism 15.

Embodiment of the Scroll Compressor

Configuration of the Scroll Compressor

The configuration of the scroll compressor 1 will now be described in details with reference to FIG. 1. The scroll compressor 1 includes the casing 11, the compression mechanism 15, an Oldham's ring 2, a fixed member 12, a motor 16, a crankshaft 17, a suction tube 19, a discharge tube 20, and a bearing 60.

The casing 11 is a cylindrical body elongated along the arrow 91. The Oldham's ring 2, the fixed member 12, the motor 16, the crankshaft 17, and the bearing 60 are disposed inside the casing 11.

The motor 16 includes a stator 51 and a rotor 52. The stator 51 is an annular stator secured to the inner wall 11*a* of the casing 11. The rotor 52 is accommodated inside the stator 51. The rotor 52 faces to the stator 51 across an air gap.

The crankshaft 17 is elongated along the arrow 91, and includes a main shaft portion 17*a* and an eccentric shaft portion 17*b*. The main shaft portion 17*a* rotates about a rotational axis 90, and is linked to the rotor 52. The eccentric shaft portion 17*b* is disposed at a position not centered at the rotational axis 90, and is linked to the upper side of the main shaft portion 17*a*. The end of the lower side of the crankshaft 17 is supported slidably by the bearing 60.

The fixed member 12 is a housing shown in FIG. 1, and is secured hermetically to the inner wall 11*a* of the casing 11. The fixed member 12 is secured to the inner wall 11*a* through press-fitting, welding, and so forth. The fixed member 12 may be secured to the inner wall 11*a* through sealing.

The fixed member 12 is secured hermetically to the inner wall 11*a*. That is, the fixed member 12 separates air-tightly the interior space of the casing 11 into a lower space 28 on the lower side of the fixed member 12 and an upper space 29 on the upper side of the fixed member 12. Therefore, the fixed member 12 can resist the pressure difference between the lower space 28 and the upper space 29. The pressure in the upper space 28 is higher than that in the upper space 29.

The fixed member 12 includes a concaved portion 31 which is opened toward the upper side and is cut around the rotational axis 90. The eccentric shaft portion 17*b* of the crankshaft 17 fits in the concaved portion 31. The fixed member 12 also includes a bearing 32 and a through hole 33. The main shaft portion 17*a* of the crankshaft 17 passes through the through hole 33, and is supported by the bearing 32.

The fixed scroll 24 has a concave surface 42 on its upper side. The discharge space 45 is defined by the concaved surface 42 and a lid 44. The lid 44 separates two spaces of different pressures. One of the two spaces is the discharge space 45, while the other is the upper space 29.

The movable scroll 26 includes further a bearing 26*c*. The bearing 26*c* is linked to the lower side of the second plate portion 26*a*. The bearing 26*c* supports slidably the eccentric shaft portion 17*b* of the crankshaft 17.

Flow of Refrigerant

The refrigerant flow inside the scroll compressor 1 will now be described with reference to FIG. 1. The arrows in FIG. 1 indicate the refrigerant flow. Refrigerant is drawn via the suction tube 19 to be guided into the compression space 40 in the compression mechanism 15. The refrigerant compressed in the compression space 40 is discharged into the discharge space 45 via the discharge hole 41 formed in the proximity of the center of the fixed scroll 24. Therefore, the pressure in the discharge space 45 is high. On the other hand, the pressure in the upper space 29 separated from the discharge space 45 by the lid 44 stays low.

The refrigerant in the discharge space 45 flows into the lower space 28 below the fixed member 12, via a through hole 46 formed in the fixed scroll 24 and a through hole 48 formed in the fixed member 12 in this order. In the lower space 28, the refrigerant is guided into a gap 55 by a guide 58. The gap 55 is formed between a portion of a side of the stator 51 and the casing 11.

After that, the refrigerant flows into the lower side of the motor 16 via the gap 55, and flows into the discharge tube 20 via an air gap in the motor 16 or a gap 56. The gap 56 is formed between a portion of a side of the stator 51 and the casing 11.

What is claimed is:

1. A compression mechanism configured to be used in a scroll compressor, the compression mechanism comprising:

a fixed scroll; and a movable scroll, one of the fixed scroll and the movable scroll being a cast iron molding fabricated through semi-molten die casting, and the other of the fixed scroll and the movable scroll being a grey iron casting, the grey iron casting being constructed of a different material than the cast iron molding, and the cast iron molding having higher strength and higher stiffness than the grey iron casting.

2. A compression mechanism configured to be used in a scroll compressor, the compression mechanism comprising:

a fixed scroll; and a movable scroll, one of the fixed scroll and the movable scroll being a cast iron molding fabricated through semi-molten die casting, the other of the fixed scroll and the movable scroll being a grey iron casting, and a sum of a first graphite area ratio and a second graphite area ratio being greater than or equal to 10% and less than or equal to 20%, the first graphite area ratio being on a surface of the cast iron molding, and the second graphite area ratio being on a surface of the grey iron casting.

3. The compression mechanism according to claim 2, wherein the first graphite area ratio on the surface of the cast iron molding is greater than or equal to 2% and less than or equal to 6%.

4. A compression mechanism configured to be used in a scroll compressor, the compression mechanism comprising:

a fixed scroll; and a movable scroll, one of the fixed scroll and the movable scroll being a cast iron molding fabricated through semi-molten die casting, the other of the fixed scroll and the movable scroll being a grey iron casting, and a tensile strength of the grey iron casting being greater than or equal to 250N/mm$^2$ and less than 300N/mm$^2$.

5. The compression mechanism according to claim 1, wherein the fixed scroll is the grey iron casting, and the movable scroll is the cast iron molding.

6. The compression mechanism according to claim 5, wherein the movable scroll is placed and pushed against the fixed scroll.

7. The compression mechanism according to claim 5, wherein the fixed scroll has a first scroll portion and a first plate portion, and the movable scroll has a second scroll portion and a second plate portion, the first and second scroll portions extend in involute shapes, the first scroll portion engages with the second scroll portion, and the first and second plate portions hold the first and second scroll portions, respectively, the first plate portion has a through hole, the through hole connects a first space and a second space, the first space has an involute shape defined by the first scroll portion, and the second space is located on the opposite side of the movable scroll, and the second scroll portion is arranged to cover an opening of the through hole, the opening is located on the side of the first space.

8. The compression mechanism according to claim 7, wherein the first scroll portion covers a portion of the opening of the through hole as viewed from a side of the movable scroll.

9. The compression mechanism according to claim 5, wherein the fixed scroll has a first scroll portion, and the movable scroll has a second scroll portion, the first and second scroll portions extend in involute shapes, and the first scroll portion engages with the second scroll portion, and the movable scroll has an extended portion that extends from an end of an outmost wall of the second scroll portion and does not engage with the first scroll portion.

10. A compression mechanism configured to be used in a scroll compressor, the compression mechanism comprising:

a fixed scroll and a movable scroll, one of the fixed scroll and the movable scroll being a cast iron molding fabricated through semi-molten die casting.

the other of the fixed scroll and the movable scroll being a grey iron casting the fixed scroll having a first scroll portion, and the movable scroll having a second scroll portion, the first and second scroll portions extending in involute shapes, and the first scroll portion engaging with the second scroll portion, a thickness ratio of a first thickness to a second thickness being calculated based on a Young's modulus ratio of a Young's modulus of the cast iron molding to a Young's modulus of the grey iron casting, and the first thickness being the thickness of the first or second scroll portion of the cast iron molding, and the second thickness being the thickness of the first or second scroll portion of the grey iron casting.

11. The compression mechanism according to claim 10, wherein the thickness ratio is less than or equal to the reciprocal of the Young's modulus ratio.

12. The compression mechanism according to claim 10, wherein the Young's modulus of the cast iron molding is 175GPa or more and 190GPa or less.

13. A scroll compressor including the compression mechanism according to claim 1.

14. The scroll compressor according to claim 13, wherein the scroll compressor compresses refrigerant composed mostly of carbon dioxide.

* * * * *

UNITED STATES PATENT AND TRADEMARK OFFICE

CERTIFICATE OF CORRECTION

PATENT NO. : 8,512,017 B2
APPLICATION NO. : 12/671282
DATED : August 20, 2013
INVENTOR(S) : Satoshi Yamamoto et al.

It is certified that error appears in the above-identified patent and that said Letters Patent is hereby corrected as shown below:

In the Claims:

Column 16,
Line 27, "a fixed scroll and" should read -- a fixed scroll; and --.

Signed and Sealed this
Fifth Day of November, 2013

Teresa Stanek Rea
*Deputy Director of the United States Patent and Trademark Office*